US005439551A

United States Patent [19]

Meikle et al.

[11] Patent Number: 5,439,551

[45] Date of Patent: * Aug. 8, 1995

[54] CHEMICAL-MECHANICAL POLISHING TECHNIQUES AND METHODS OF END POINT DETECTION IN CHEMICAL-MECHANICAL POLISHING PROCESSES

[75] Inventors: Scott Meikle; Trung T. Doan, both of Boise, Id.

[73] Assignee: Micron Technology, Inc., Boise, Id.

[ * ] Notice: The portion of the term of this patent subsequent to Jun. 29, 2010 has been disclaimed.

[21] Appl. No.: 205,312

[22] Filed: Mar. 2, 1994

[51] Int. Cl.[6] ..... H01L 21/304

[52] U.S. Cl. ..... 156/626.1; 437/7

[58] Field of Search ..... 437/7; 156/626, 636

[56] References Cited

U.S. PATENT DOCUMENTS

| | | | |
|---|---|---|---|
| 4,793,895 | 12/1988 | Kaanta et al. | 156/627 |
| 4,839,311 | 6/1989 | Riley et al. | 437/7 |
| 5,036,015 | 7/1991 | Sandhu et al. | 437/8 |
| 5,069,002 | 12/1991 | Sandhu et al. | 51/165 |
| 5,081,421 | 1/1992 | Miller et al. | 324/671 |
| 5,081,796 | 1/1992 | Schultz | 51/165 |
| 5,196,353 | 3/1993 | Sandhu et al. | 156/636 |
| 5,222,329 | 6/1993 | Yu | 51/165.77 |
| 5,240,552 | 8/1993 | Yu et al. | 156/636 |
| 5,272,117 | 12/1993 | Roth et al. | 437/228 |
| 5,308,438 | 5/1994 | Cote et al. | 156/636 |
| 5,318,663 | 6/1994 | Buti et al. | 156/636 |
| 5,334,281 | 8/1994 | Doerre et al. | 156/636 |

FOREIGN PATENT DOCUMENTS 2439795 4/1975 Germany .

53-17078 2/1978 Japan .

*Primary Examiner*—George Fourson
*Assistant Examiner*—Thomas G. Bilodeau
*Attorney, Agent, or Firm*—Wells, St. John, Roberts, Gregory & Matkin

[57] ABSTRACT

A semiconductor processing method of detecting polishing end point in a chemical-mechanical polishing planarization process includes the following steps: a) chemical-mechanical polishing an outer surface of a semiconductor substrate using a chemical-mechanical polishing pad; b) during such chemical-mechanical polishing, measuring sound waves emanating from the chemical-mechanical polishing action of the substrate against the pad; c) detecting a change in the sound waves as the surface being chemical-mechanical polished becomes substantially planar; and d) ceasing chemical-mechanical polishing upon detection of the change. Alternately instead of ceasing chemical-mechanical polishing, a mechanical polishing process operational parameter could be changed upon detection of the change and then continuing mechanical polishing with the changed operational parameter. In another aspect of the invention, first and second layers to be polished are provided on a semiconductor wafer. The second layer is in situ measured during polishing to determine its substantial complete removal from the substrate by chemical-mechanical polishing. Such in situ measuring of the second layer during polishing might be conducted by a number of different manners, such as by acoustically, chemically, optically or others. Also claimed is a polishing apparatus for acoustically monitoring polishing action.

6 Claims, 3 Drawing Sheets

CHEMICAL-MECHANICAL POLISHING TECHNIQUES AND METHODS OF END POINT DETECTION IN CHEMICAL-MECHANICAL POLISHING PROCESSES

TECHNICAL FIELD

This invention principally relates to chemical-mechanical polishing in the processing of semiconductor substrates.

BACKGROUND OF THE INVENTION

In semiconductor manufacture, extremely small electronic devices are formed in separate dies in a thin, flat semiconductor wafer. In general, various materials which are either conductive, insulating, or semiconducting are utilized in the fabrication of integrated circuitry on semiconductor wafers. These materials are patterned, doped with impurities, or deposited in layers by various processes to form integrated circuits.

Increasing circuitry miniaturization and a corresponding increase in density has resulted in a high degree of varying topography being created on an outer wafer surface during fabrication. It is often necessary to polish a wafer surface having varying topography to provide a substantially planar surface. One such process is chemical-mechanical polishing. In general, this process involves holding and rotating a thin, flat wafer of the semiconductor material against a wetted polishing surface under controlled chemical, pressure, and temperature conditions. A chemical slurry containing a polishing agent, such as alumina or silica, is utilized as the abrasive medium. Additionally, the chemical slurry contains selected chemicals which etch various surfaces of the wafer during processing. The polishing effect on the wafer results in a chemical and mechanical action.

A particular problem encountered in chemical-mechanical polishing is the determination that the surface has been planarized to a desired end point. It is often desirable, for example, to remove a thickness of oxide material which has been deposited onto a substrate, and on which a variety of integrated circuit devices have been formed. In removing or planarizing this oxide, it is desirable to remove the oxide to the top of the various integrated circuits devices without removing any portion of the devices. Typically, this planarization process is accomplished by control of the rotational speed, downward pressure, chemical slurry, and time of polishing.

The planar endpoint of a planarized surface is typically determined by mechanically removing the semiconductor wafer from the planarization apparatus and physically measuring the semiconductor wafer by techniques which ascertain dimensional and planar characteristics. If the semiconductor wafer does not meet specification, it must be loaded back into the planarization apparatus and planarized again. Alternately, an excess of material may have been removed from the semiconductor wafer, rendering the part as substandard.

Certain techniques have also been developed for in situ detection of chemical-mechanical planarization. Typically these techniques rely on measurements of the physical thickness of the layer being polished, or judge end point from electrical changes that occur when the polishing layer is completely removed. Such are disclosed, by way of example, in U.S. Pat. Nos. 4,793,895; 5,036,015; 5,069,002; 5,081,421; and 5,081,796.

A further issue in chemical-mechanical planarizing in some cases is achieving a desired planarity and removing a minimum amount of the material being planarized. For example in a process optimized for throughput, the amount of removed material is adjusted to be the minimum amount necessary to achieve a desired result. In a planarizing process, the desired result is to have a completely planarized end surface.

It would be desirable to develop improved methods of chemical-mechanical polishing, and improved methods of end point detection in chemical-mechanical polishing.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
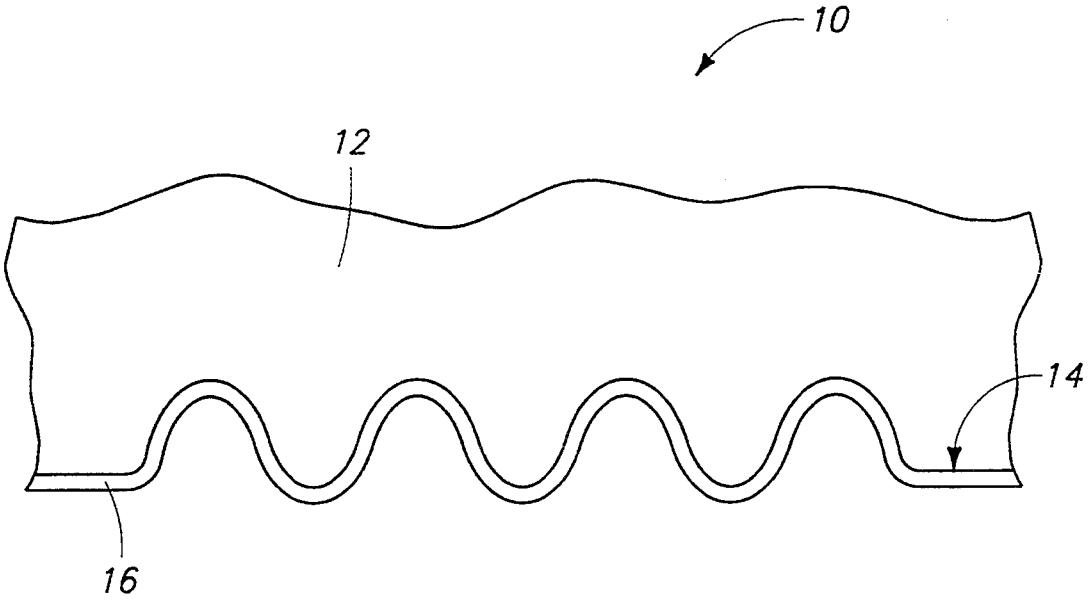
FIG. 1 is a diagrammatic sectional view of a semiconductor wafer fragment processed in accordance with the invention.

This disclosure of the invention is submitted in furtherance of the constitutional purposes of the U.S. Patent Laws "to promote the progress of science and useful arts" (Article 1, Section 8).

In accordance with one aspect of the invention, a semiconductor processing method of detecting polishing end point in a chemical-mechanical polishing planarization process comprises the following steps:

- chemical-mechanical polishing an outer surface of a semiconductor substrate using a chemical-mechanical polishing pad;
- during such chemical-mechanical polishing, measuring sound waves emanating from the chemical-mechanical polishing action of the substrate against the pad;
- detecting a change in the sound waves as the surface being chemical-mechanical polished becomes substantially planar; and
- ceasing chemical-mechanical polishing upon detection of the change.

In accordance with another aspect of the invention, a semiconductor processing chemical-mechanical polishing method comprises the following steps:

- chemical-mechanical polishing an outer surface of a semiconductor substrate using a chemical-mechanical polishing pad;
- during such chemical-mechanical polishing, measuring sound waves emanating from the chemical-mechanical polishing action of the substrate against the pad;
- detecting a change in the sound waves as the chemical-mechanical polishing action continues; and changing a chemical-mechanical polishing process operational parameter upon detection of the change and then continuing chemical-mechanical polishing with the changed operational parameter.

Example chemical-mechanical polishing process parameters include pressure of the wafer against the pad, slurry composition, slurry temperature, slurry flow rate, rotational speed of both the pad and the wafer, etc. In the course of detecting a change in the sound waves emanating from the process, multiple of these chemical-mechanical polishing process operational parameters might be desirably changed.

The sound emanating from chemical-mechanical polishing action of a given material and pad of a completely planarized layer will provide a determinable acoustic signature. Likewise, planarizing of the same material or materials with the same given pad where the surface has varying topography will produce different acoustic signatures. By monitoring the sound emanating during the process, a determination can be made when a substantially planarized layer has been attained. Chemical-mechanical polishing action at that point can be ceased. Alternately, change in the sound waves emanating from the polishing surface during polishing can be used to monitor a change in the process even where endpoint has not been reached, thus enabling any of various chemical-mechanical polishing process parameters to be varied to change the polishing action. This disclosure is similar to our U.S. Pat. application Ser. No. 08/112,759 filed on Aug. 25, 1993 and entitled, "System and Method for Real-Time Control of Semiconductor Wafer Polishing, and a Polishing Head", listing inventors as Gurtej S. Sandhu and Trung T. Doan. This 08/112,759 application, is hereby incorporated by reference.

Additionally, structure could be provided which is tailored to produce a certain type of acoustic signature that changes as the topography of the structure is removed. For example, two parallel lines of topography situated such that the pad velocity vector is perpendicular to the lines will generate a standing wave in the pad with the lines acting as standing wave nodes. Part of the energy dissipated by the standing waves can be expected to be in the form of a detectable acoustical signal. The frequency of the acoustical signal can be tailored by selecting an appropriate spacing between the lines dependent of the pad rigidity and the relative velocity of the pad surface. As the lines disappear, the acoustical signature emanated by the polishing pad will change.

In accordance with another aspect of the invention, a semiconductor processing method of chemical-mechanical polishing comprises the following sequential steps:

providing a first layer of varying topography to be chemical-mechanical polished onto a semiconductor substrate, the first layer comprising a first material;

providing a second layer to be chemical-mechanical polished over the first layer, the second layer comprising a second material which chemical-mechanical polishes at a rate slower than the first layer for a range of chemical-mechanical polishing process operational parameters;

chemical-mechanical polishing the second layer to a point where a portion of the first layer is outwardly exposed to chemical-mechanical polishing action, thus defining a polishing surface having outwardly exposed portions of each of the first and second layers;

chemical-mechanical polishing exposed portions of each of the first and second layers within the range of parameters; and in situ measuring the second layer during polishing to determine its substantial complete removal from the substrate by chemical-mechanical polishing.

Figure 2:
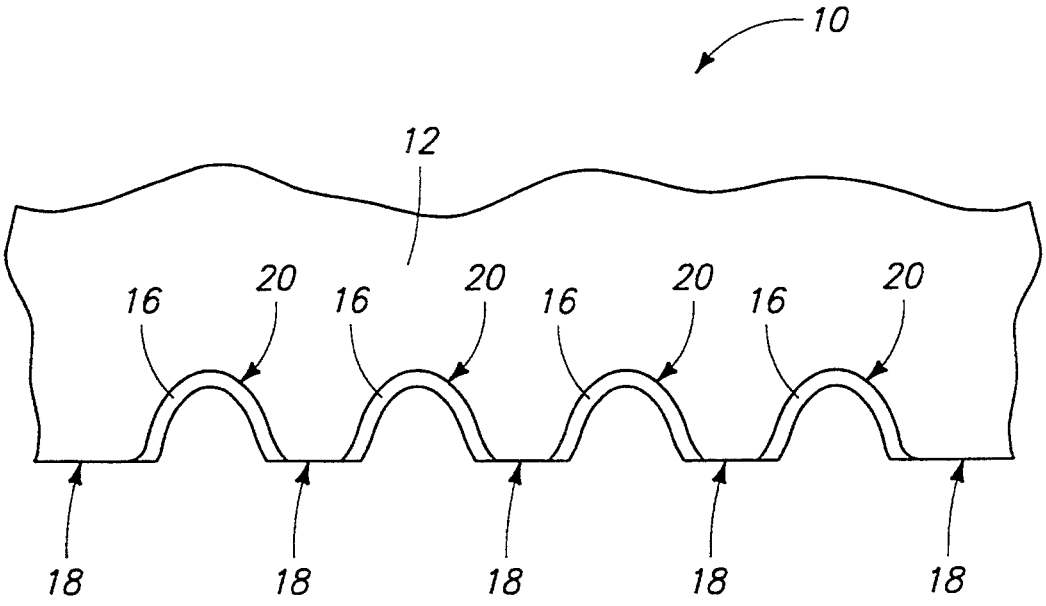
FIG. 2 is a view of the FIG. 1 wafer taken at a processing step subsequent to that shown by FIG. 1.

An example process in accordance with this aspect of the invention is described with respect to FIGS. 1 and 2. There illustrated diagrammatically is a semiconductor wafer fragment 10 comprising a substrate 12. Substrate 12 in this described example can be considered as constituting a first layer having an outer surface 14 of varying topography which is to be chemical-mechanical polished. Circuitry might be provided within the bulk substrate, with the material 12 comprising a doped or undoped silicon dioxide layer.

A second layer 16 is provided over first layer 12. Second layer 16 will comprise some other material which chemical-mechanical polishes at a rate slower than first layer 12 for a given range of chemical-mechanical polishing process operational parameters.

Referring to FIG. 2, substrate 10 and second layer 16 have been chemical-mechanical polished to a point where portions 18 of first layer 12 are outwardly exposed to chemical-mechanical polishing action, thus defining an outer polishing surface having outwardly exposed portions of each of the first and second layers. Isolated regions of layer 16 are indicated with arrows 20 in FIG. 2. Such exposed portions of each of the first and second layers are chemical-mechanical polished within the given range of parameters. Such parameters would clearly be determinable by a person of skill in the art depending upon various materials utilized. For example, where layer 16 comprises a titanium metal or alloy and layer 12 comprised silicon dioxide, example aqueous slurry composition and parameters for a chemical-mechanical polishing process could include potassium hydroxide, silica, alumina, hydrogen peroxide using a wafer down-force at 3–10 psi and a pad/wafer relative velocity of 4–400 cm/sec. During such polishing, the second layer material 16 functions as a hard capping layer preventing removal of the furthest indented topography while the outermost surface thereof is chemical-mechanical polished.

During such polishing, portions 20 of second layer material remaining are in situ measured during polishing to determine when such material has substantially been completely removed from the substrate by the chemical-mechanical polishing. Upon determination of such complete removal, the chemical-mechanical polishing is ceased. Thus, minimum removal of material 12 inwardly of the furthest projection of the indentations is prevented. Alternately, further chemical-mechanical polishing of layer 12 could be conducted to provide a desired thickness thereof.

In situ measuring of the second layer during polishing might be conducted by a number of different manners, such as by way of example only, acoustically, chemically or optically.

For example for acoustical measuring, it is anticipated that the acoustical signature emanating from the polishing surface will change upon complete removal of the second layer material. Accordingly, a change in sound waves emanating from the wafer during polishing will be detected upon substantially complete removal of the second layer material from the substrate.

In the case where a second layer with a lower polish ratio is deposited overtop a higher polish ratio first layer, the improved selectivity due to the second layer reduces rounding effects from the polish that can blur the acoustical signal. Therefore, it can be expected that the acoustical signature will be more distinct when second layer material is present.

Alternately, the in situ measuring could be conducted in a chemical manner. Here, the chemical-mechanical polishing slurry itself is monitored for a chemical change therein upon substantially complete removal of the second layer material from the substrate. For example, the second layer material being removed from the substrate might have an impact upon the pH of the chemical-mechanical polishing slurry. For example, if the first layer material comprises a boron and phosphorus doped oxide and the second layer material was lightly or undoped oxide, the amount of phosphorus going into the flowing slurry effluent would increase as the undoped layer was removed. Phosphorus addition will lower slurry pH.

Alternately, the material removed might be reactive with other components in the slurry. Upon complete removal of the second layer material, there would be a pH change or no longer be a reaction with material in the slurry as a result of the reactant second layer material no longer being added to the chemical-mechanical polishing slurry.

Figure 3:
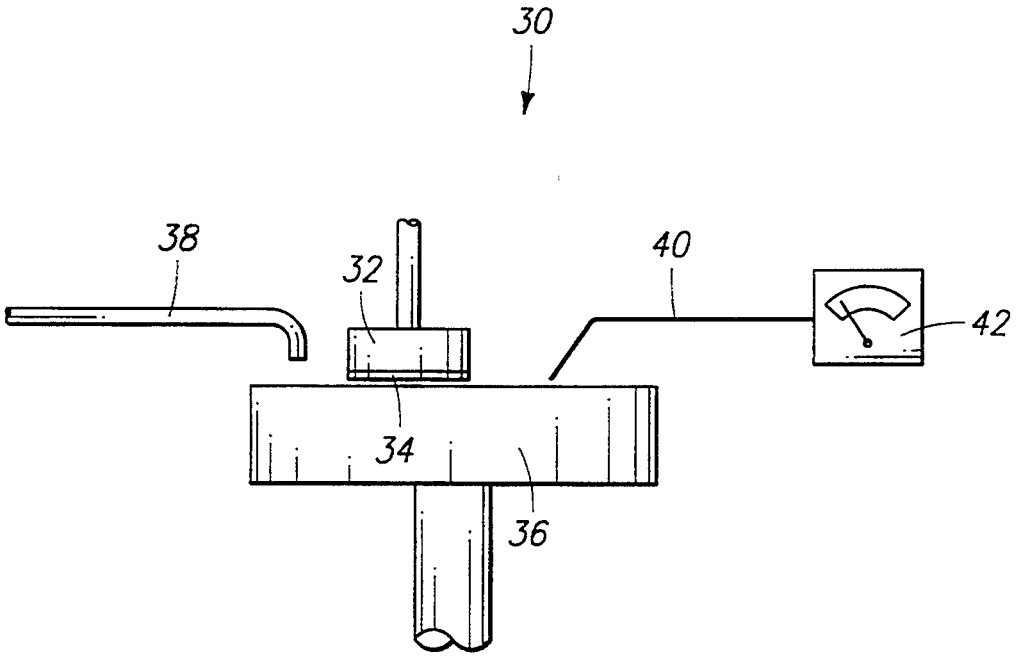
FIG. 3 is a diagrammatic representation of a semiconductor wafer polisher.

A system for monitoring pH in manners such as described above is diagrammatically represented in FIG. 3 generally with reference numeral 30. Such includes a rotatable semiconductor wafer carrier 32 having a wafer 34 mounted thereto. A rotatable polishing platen 36 is positioned to engage against wafer 34. Chemical-mechanical polishing slurry is fed onto platen 36 through a slurry dispensing tube 38. A pH monitoring system includes a suitable pH lead 40 which contacts slurry atop platen 36, with pH thereof being reported by a meter 42.

As a complementary or additional feature, some form of chemical indicator could be provided in the chemical-mechanical polishing slurry which is indicatingly reactive with components of the second layer removed from the substrate, or with first layer components. The chemical-mechanical polishing slurry would then be monitored for a chemical change in the indicator upon substantially complete removal of the second layer material from the substrate. An example would be an optically detectable color change which would occur when no more second layer material was being added to the chemical-mechanical polishing slurry.

Figure 4:
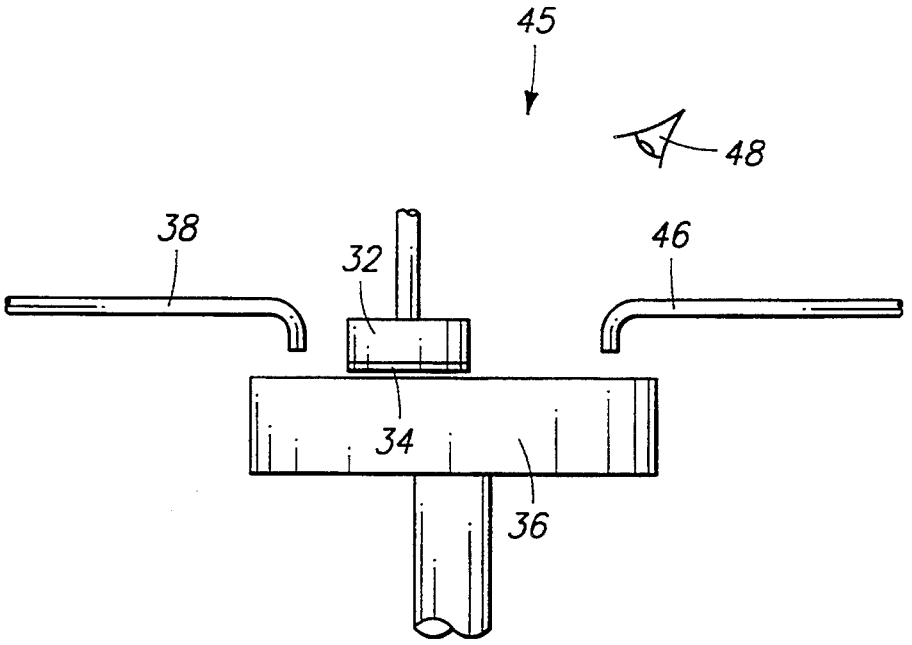
FIG. 4 is a diagrammatic representation of an alternate semiconductor wafer polisher.

As a more specific example, if the first layer material was silicon dioxide and the second layer material was titanium dioxide, a titration could be performed during polishing to measure Ti content or concentration in the slurry. The titration would preferably be performed by metering titrant directly onto the pad and slurry during polishing. An example system for doing so is diagrammatically represented in FIG. 4, and is indicated generally with numeral 45. Like numbers from the FIG. 3 system are utilized where appropriate. A titrant dispensing tube 46 is provided to meter the titrant into the slurry during polishing. An optical based detection means 48 could be provided to observe titration results as polishing continues. Such might detect color change or some other optical parameter to determine when the second layer has been substantially removed.

Figure 5:
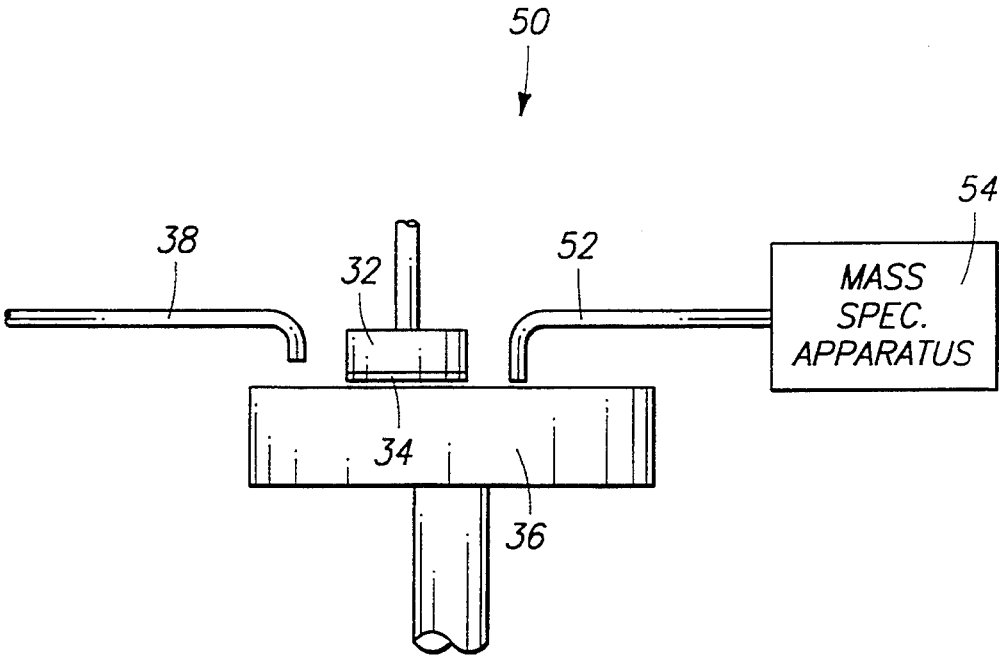
FIG. 5 is a diagrammatic representation of another alternate semiconductor wafer polisher.

Alternately, a sample of the effluent could be tested for Ti or other suitable substance by withdrawing a sample of the slurry during polishing and using some qualitative or quantitative analytical technique on the withdrawn sample, such as mass spectroscopy. An example system for doing so is diagrammatically represented in FIG. 5, and is indicated generally with numeral 50. Such includes a slurry withdrawal tube 52 which passes slurry to an analytical device, such as a mass spectrograph 54, to provide real-time information about slurry composition.

As another example, in situ measuring might be conducted in some other optical manner. For example, the second layer material could be selected to have different reflective or other optical properties than the underlying material being planarized. The surface of the wafer would be monitored optically during polishing, with a change being detected upon complete removal of the second layer material from the substrate layer. Laser or other light sources impinged onto the polishing surface and reflected therefrom could be monitored for optically determining removal of the second layer from the substrate. By way of example only, specific laser optical techniques include laser interferometry, and the method disclosed in our co-filed application, now U.S. Pat. No. 5,413,941, listing Daniel A. Koos and Scott G. Meikle as inventors and entitled "Optical End Point Detection Methods In Semiconductor Planarizing Polishing Processes". Such application is hereby incorporated by reference.

In accordance with another aspect of the invention, a semiconductor processing method of chemical-mechanical polishing comprises the following sequential steps:

- providing a first layer of varying topography to be chemical-mechanical polished onto a semiconductor substrate, the first layer being comprised of a first material;
- providing a second layer to be chemical-mechanical polished over the first layer, the second layer comprising a second material which is different from the first material;
- chemical-mechanical polishing the second layer to a point where a portion of the first layer is outwardly exposed to chemical-mechanical polishing action, thus defining a polishing surface having outwardly exposed portions of each of the first and second layers;
- chemical-mechanical polishing exposed portions of each of the first and second layers; and
- monitoring the chemical-mechanical polishing slurry for a chemical change therein upon substantially complete removal of the second layer material from the substrate.

The chemical change could be imparted and monitored by any of the chemical methods referred to above. This aspect of the invention differs from that described above in that the properties of the first and second layer materials and the chemical-mechanical polishing being conducted are regardless of the chemical-mechanical polishing removal rates of the first and second layer materials relative to one another. Further, the slurry might be monitored for either of first or second material components. For example, the monitoring could comprise chemically monitoring decreasing concentration of second material components in the chemical-mechanical polishing slurry as polishing progresses. As more second material is removed, less second material will be added to the slurry thus lowering its concentration therein. Alternately by way of example only, the monitoring could comprise chemically monitoring increasing concentration of first material components in the chemical-mechanical polishing slurry as polishing progresses. As more second material is removed, more polishing of first material will occur putting more of its components into the slurry.

In some instances, the quantity of wafer surface having high topography area vs. low topography area might be considerably high. In such instances it might be difficult to acoustically or otherwise determine removal of the hard or second layer material. In such instances, it might be desirable to provide other finished circuit functionally useless material in other areas of the wafer to increase the volume of second layer material being removed such that accurate complete removal thereof can be determined.

The invention grew out of needs and problems associated with the unique and distinct art area of chemical-mechanical polishing. However, it has been determined that certain aspects of the above invention may have application in strictly mechanical polishing processes. In accordance with this aspect of the invention, a semiconductor processing method of detecting polishing end point in a mechanical polishing planarization process comprising the following steps:

mechanically polishing an outer surface of a semiconductor substrate using a mechanical polishing pad;

during such mechanical polishing, measuring sound waves emanating from the mechanical polishing action of the substrate against the pad;

detecting a change in the sound waves as the surface being mechanically polished becomes substantially planar; and ceasing mechanical polishing upon detection of the change. Alternately instead of ceasing the mechanical polishing action, a mechanical polishing process operational parameter could be changed upon detection of the sound wave change and then continuing mechanical polishing with the changed operational parameter.

Figure 6:
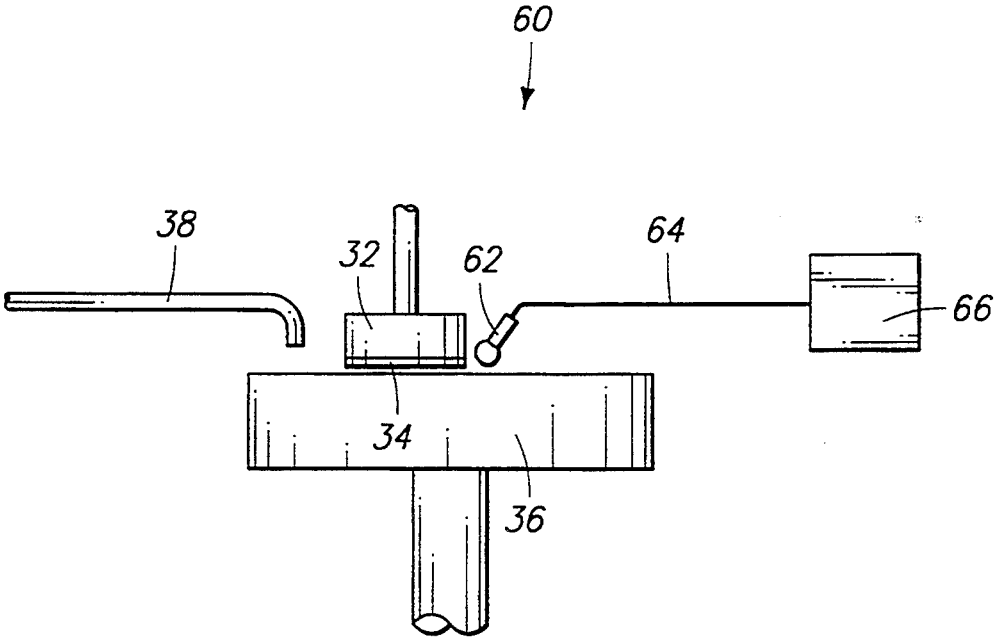
FIG. 6 is a diagrammatic representation of yet another alternate semiconductor wafer polisher.

An example inventive system 60 for acoustically monitoring mechanical or chemical-mechanical polishing is diagrammatically represented in FIG. 6. Such includes a microphone 62 positioned relative to wafer carrier 32 and polishing platen 36 to pick-up sonic waves emanating from the wafer and the platen during polishing. A suitable line 64 extends to some acoustic analyzer 66 for monitoring sound and changes in sound from the polishing action.

In compliance with the statute, the invention has been described in language more or less specific as to structural, compositional and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A semiconductor processing method of detecting polishing end point in a chemical-mechanical polishing planarization process comprising the following steps:

chemical-mechanical polishing an outer surface of a semiconductor substrate using a chemical-mechanical polishing pad;

during such chemical-mechanical polishing, measuring sound waves emanating from the chemical-mechanical polishing action of the substrate against the pad;

detecting a change in the sound waves as the surface being chemical-mechanical polished becomes substantially planar; and ceasing chemical-mechanical polishing upon detection of the change.

2. A semiconductor processing chemical-mechanical polishing method comprising the following steps:

chemical-mechanical polishing an outer surface of a semiconductor substrate using a chemical-mechanical polishing pad;

during such chemical-mechanical polishing, measuring sound waves emanating from the chemical-mechanical polishing action of the substrate against the pad;

detecting a change in the sound waves as the chemical-mechanical polishing action continues; and changing a chemical-mechanical polishing process operational parameter upon detection of the change and then continuing chemical-mechanical polishing with the changed operational parameter.

3. The semiconductor processing chemical-mechanical polishing method of claim 2 comprising changing multiple chemical-mechanical polishing process operational parameters upon detection of the change and then continuing chemical-mechanical polishing with the changed operational parameters.

4. A semiconductor processing method of chemical-mechanical polishing comprising the following sequential steps:

providing a first layer of varying topography to be chemical-mechanical polished onto a semiconductor substrate, the first layer comprising a first material;

providing a second layer to be chemical-mechanical polished over the first layer, the second layer comprising a second material which chemical-mechanical polishes at a rate slower than the first layer for a range of chemical-mechanical polishing process operational parameters;

chemical-mechanical polishing the second layer to a point where a portion of the first layer is outwardly exposed to chemical-mechanical polishing action, thus defining polishing surface having outwardly exposed portions of each of the first and second layers;

chemical-mechanical polishing exposed portions of each of the first and second layers within the range of parameters; and detecting a change in sound waves emanating from the wafer during polishing upon substantially complete removal of the second layer material from the substrate.

5. A semiconductor processing method of detecting polishing end point in a mechanical polishing planarization process comprising the following steps:

mechanically polishing an outer surface of a semiconductor substrate using a mechanical polishing pad;

during such mechanical polishing, measuring sound waves emanating from the mechanical polishing action of the substrate against the pad;

detecting a change in the sound waves as the surface being mechanically polished becomes substantially planar; and ceasing mechanical polishing upon detection of the change.

6. A semiconductor processing mechanical polishing method comprising the following steps:

mechanical polishing an outer surface of a semiconductor substrate using a mechanical polishing pad;

during such mechanical polishing, measuring sound waves emanating from the mechanical polishing action of the substrate against the pad;

detecting a change in the sound waves as the mechanical polishing action continues; and changing a mechanical polishing process operational parameter upon detection of the change and then continuing mechanical polishing with the changed operational parameter.

* * * * *